United States Patent [19]

Kramer et al.

[11] 3,934,777

[45] Jan. 27, 1976

[54] MACHINE FOR THE ATTACHMENT OF FASTENERS

[75] Inventors: Friedhelm Kramer, Ennepetal-Milspe; Günter Wolfertz, Wuppertal, both of Germany

[73] Assignee: Firma Schaeffer-Homberg GmbH, Wuppertal-Barmen, Germany

[22] Filed: Aug. 15, 1974

[21] Appl. No.: 497,643

[30] Foreign Application Priority Data

Aug. 16, 1973 Germany ..... 7329772

[52] U.S. Cl. ..... 227/109

[51] Int. Cl.[2] ..... B21J 15/10

[58] Field of Search ..... 227/51, 53, 55, 56, 61, 227/62, 109, 114, 115, 116, 117, 118

[56] References Cited

UNITED STATES PATENTS

| | | | |
|---|---|---|---|
| 1,335,563 | 3/1920 | Doig | 227/109 |
| 1,832,681 | 11/1931 | Alford | 227/51 |
| 1,944,510 | 1/1934 | Hayden | 227/55 |
| 2,374,345 | 4/1945 | Gookin | 227/55 |

*Primary Examiner*—Granville Y. Custer, Jr.
*Attorney, Agent, or Firm*—Ernest G. Montague; Karl F. Ross; Herbert Dubno

[57] ABSTRACT

The invention relates to a machine having a drive for the attachment of fasteners such as rivets and the like. Each of two conventionally and reversibly interchangeable containers have engaging positions coupled to the drive and are provided to store and feed the fasteners separately to an operating position.

3 Claims, 4 Drawing Figures

MACHINE FOR THE ATTACHMENT OF FASTENERS

FIELD OF THE INVENTION

The invention relates to a machine for the attachment of fasteners stored in containers.

BACKGROUND OF THE INVENTION

Conventional machines of the above type are constructed to permit the use of only some fasteners for attachment to only a certain class of products. Thus different rivets or press fasteners are to be used or different classes for such operations must be utilized. A manufacturer of these machines must therefore produce several different types. Such operations are uneconomical, requiring storage of small numbers of a variety of different parts. It follows that a user of these machines must also possess several types of these machines depending on the products operated on, as well as different parts attachable hereto.

OBJECT OF THE INVENTION

It is accordingly an object of the invention to devise a machine which is easily manufactured, economical and can be easily and simply switched from one type of fasteners e.g. rivets of two different sizes or product to another.

SUMMARY OF THE INVENTION

The above object is realized by a machine having a drive for the attachment of fasteners such as rivets and the like using two conventionally and reversibly interchangeable containers with engaging portions coupled to the drive, which store and feed the fasteners separately to an operating position.

If it is desired to switch the machine over to handle different types of fasteners or products, switchover is achieved by simply removing one or both containers including their respective supply rails from the machine stand and replacing them with other containers. As a result of this construction only a single basic machine type is needed to handle different produts or fasteners, while the containers for storing the fasteners and the quickly replaceable riveting or fastening tools are adapted to the particular use or operation required.

It is an advantageous feature of the invention that the container housings are located on opposite sides and within an upper region of the machine stand, and that each housing also acts as carrier of a respective supply rail, which is freely slideable therein and easily detachable therefrom, and feeds parts to an operating position. If the orientation of the respective parts is to be changed, for example if upper and lower riveting parts are to be reversed, this can easily be accomplished by a mere switch of containers from one respective side of the machine stand to the other; the respective detachable supply rails are also easily interchangeable in the same fashion. If suitable designed, each respective container with its associated supply rail can also be reversed on the same side of the machine.

It is also advantageous that the machine housings are hung from the machine stand by way of plug-in pins or partly inserted screws. This permits a coupling between the machine stand and the housing by means of simple parts.

It is additionally advantageous that the coupling between the respective housings and the machine stand is secured by externally accessible screws. For this purpose screws having preferably a cylindrical head are provided for entering a key-hole shaped slit of the magazine housing. Upon the loose hanging of a housing upon partly inserted screws, the housing is secured to the machine stand by fully tightening the screws. By this means any vibrations occurring during operation of the machine do not displace the attached housing.

Each housing for each respective container is constructed so that it can be hung from the machine stand and secured thereto alternately in a reversed position; this is achieved by each side of a housing being formed with an opening, which serves either to pass a screw therethrough for attaching the housing to the stand, or permits in a reversed position of the housing the insertion of a tool, e.g. a screwdriver, to tighten a previously inserted screw.

It is also possible to increase the versatility of the machine by arranging for the arm carrying the lower tool to be settable at various heights with respect to the upper tool. By a simple reseting of the arm it is possible to change the operating depth according to the number of available resetting positions in, for example, the vertical column of the machine supporting the machine housing.

Another advantageous feature of the machine is the fact that the arm carrying the lower tool can be set so as to extend at various distances from the machine stand, and that the member carrying the upper tool can be correspondingly adjusted by spacers or the like, these spacers also being alternatively usable to increase the height of the machine.

It is finally advantageous that the machine stand is formed with a plurality of holes for fitting the arm into the stand, and that a handle is used for tightening the arm. Upon loosening of the handle the arm can be reset; this arrangement permits a precise aligning of the lower and upper arms.

All of the aforesaid features permit the retention of a basic machine type only requiring either an interchange of machine accessories or parts, such as containers or tools, or a resetting of existing parts, such as of the arm carrying the lower tool, or the member carrying the upper tool. This ensures a cost-effective usage of a machine suitable for a variety of products and fastening means.

BRIEF DESCRIPTION OF THE DRAWING

These and other features of our invention will be more clearly understood with reference to the accompanying drawing in which.

SPECIFIC DESCRIPTION

Figure 1:
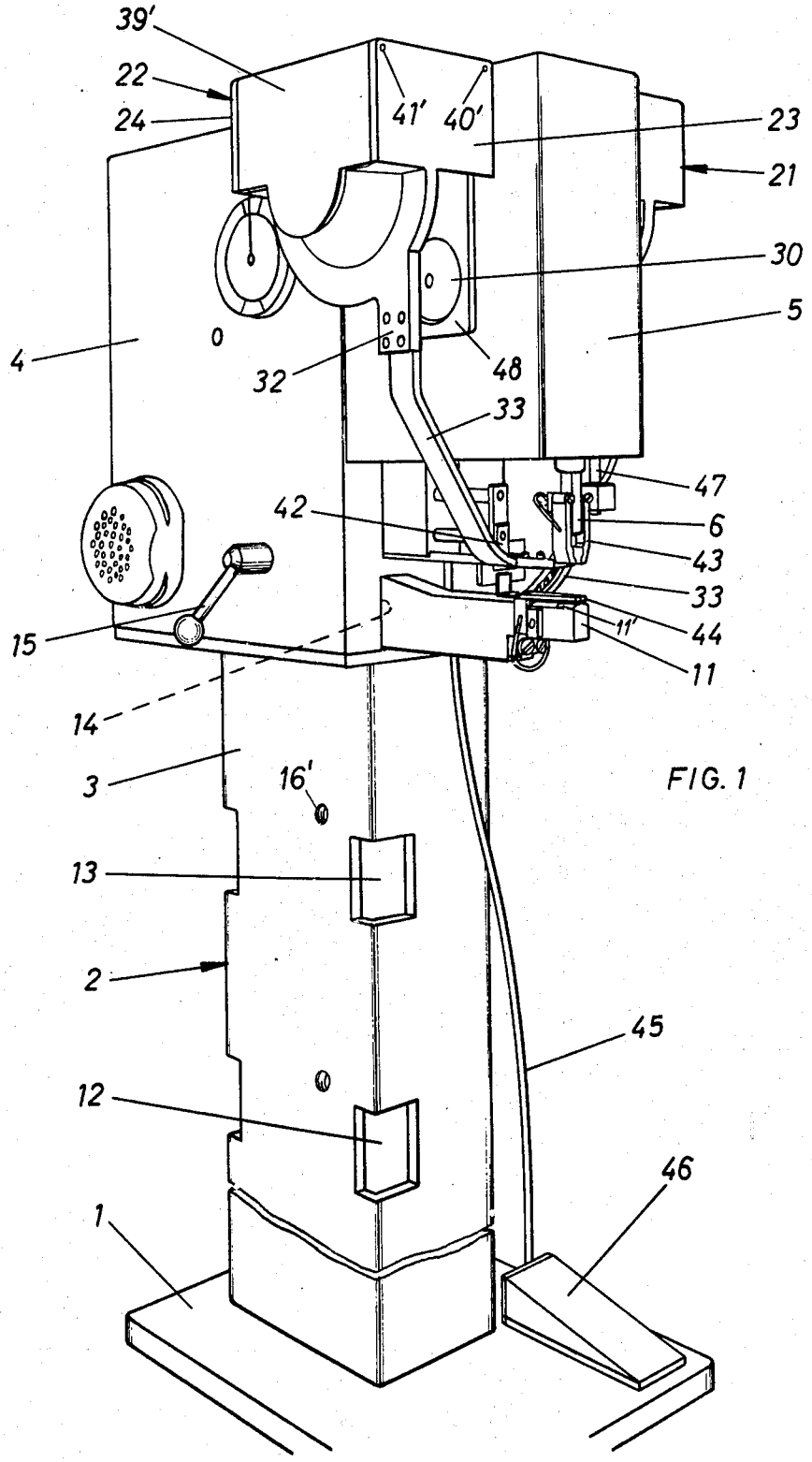
FIG. 1 is a perspective view of the machine according to our invention.

Referring to FIG. 1, a base plate 1 supports a machine stand 2. The latter includes a vertical column 3, projecting from base plate 1, supporting a machine housing 4 and a member 5 attached thereto, the latter carrying an upper tool 6 which may be a riveting tool or the like. Machine housing 4 can also be mounted on a workbench without the use of a column 3.

Figure 2:
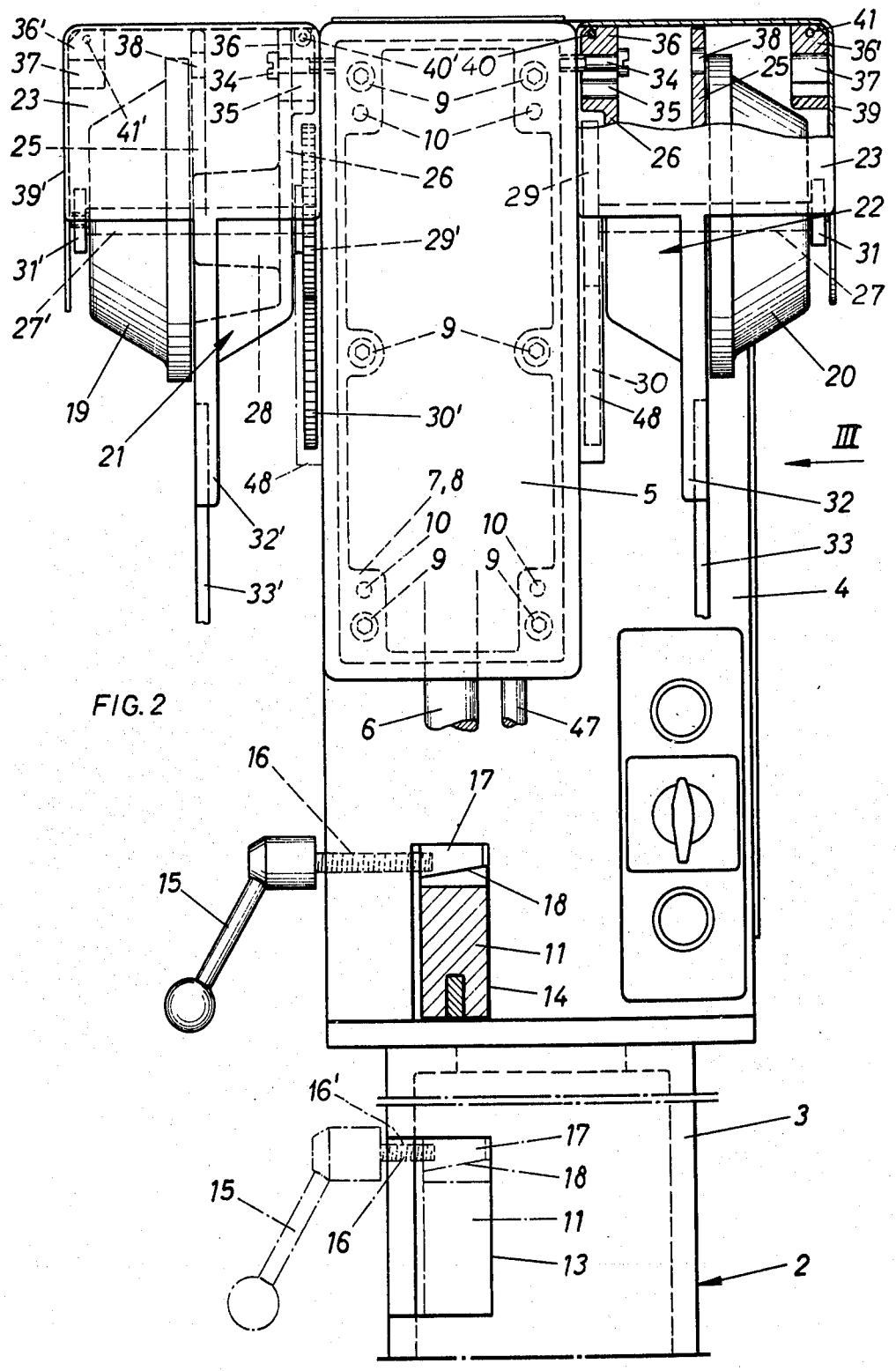
FIG. 2 is a fragmentary cross-section of the machine in elevation.
Figure 3:
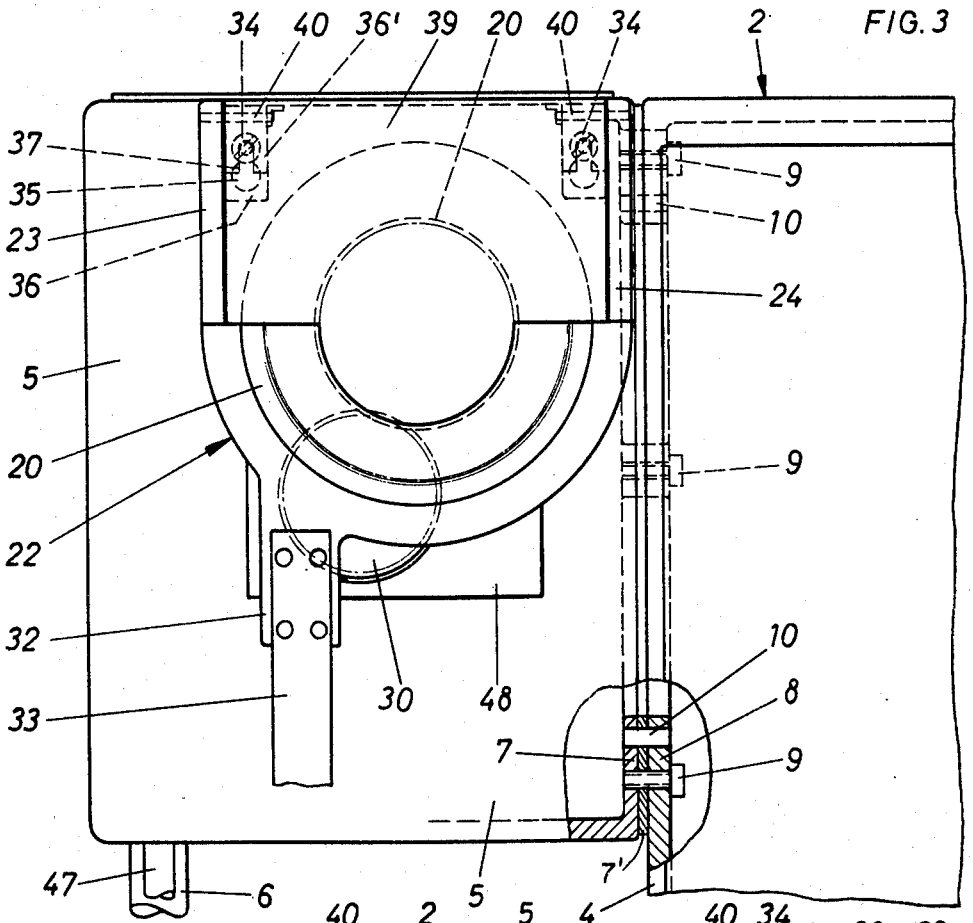
FIG. 3 is a sideview of the machine, viewed in the direction of arrow III of FIG. 2.

Details of the attachment of member 5 to machine housing 4 are discernible from FIGS. 2 and 3. The surfaces of the machine housing 4 and member 5 abutting each other are provided with respective flanges 7 and 8 and held together by both bolts 9 and dowel pins 10. If member 5, carrying tool 6 is required to be set for a greater distance from stand 2, appropriately dimensioned spacers 7' in the drawing are inserted between flanges 7 and 8, the spacers being also usable to change the height of stand 2. A distance change of upper tool 6 from stand 2 also requires a corresponding distance change of arm 11 carrying a lower tool 11'. In the version of the invention shown in FIG. 2, arm 11 is positively locked within hole 14 by means of a handle 15, which is formed with a thread 16 and presses a wedge 17 onto an inclined surface 18 of arm 11 upon being appropriately turned, thereby tightening the latter to housing 4. By loosening the aforesaid attachment device arm 11 can be adjusted to the distance to which upper tool 6 is set. It is alternately possible to fit arm 11 into holes 12 or 13, formed in stand 2, and as shown dotted in FIG. 2 to secure the former at varying heights thereto by appropriate attachment means, thereby obtaining various depths ranges of the machine according to the product handled. The thread 16 is then fitted into threaded bores 16'.

The rivets, press fasteners or the like are contained in drum-like containers 19 and 20 having respective housings 21 and 22 and are disposed in an upper region of member 5 of machine stand 2.

Each housing 21 and 22 includes two parallel outer walls 23 and 24 which are connected by a central wall 25 and an outer wall 26, and a hub 28 for supporting a shaft 27 (or 27') extending from the latter. Shafts 27 and 27' are provided on one respective side with a gear wheel 29 and 29' which mate with respective drive wheels 30 and 30' being supported in part 5 of machine stand 2, i.e. gear wheels 30 and 30' of member 5 have a common axle and are therefore jointly driven. Shafts 27 and 27' are provided on their respective other side with threaded knobs 31 and 31' for axially supporting respective drum-like containers 19 and 20; a protective plate 48 is associated with the gear drive. The gear wheel periphery is concealed by plate 48 in FIGS. 1 and 3.

Central wall 25 extends and continues downwards by means of arms 32 and 32', on which respective supply rails 33 and 33' slide freely. As is discernible from FIG. 1 supply rail 33 feeds parts to upper tool 6, while supply rail 33' feeds parts at an appropriate orientation to lower tool 11'. Supply rails 33 and 33' are preferably attached to respective arms 32 and 32' by being screwed thereon.

Containers 21 and 22 are fastened to respective sides of machine stand 2 by cylindrical-head screws 34 disposed at an equal height, openings 35 and 37 being associated therewith. Openings 35 are shaped in the form of a keyhole and extend within thickened portions 36 of machine housing 4, while slits 37 are formed within thickened portions 36. Openings 35 and 37 each have respective wide and narrow regions as shown in FIG. 3, each respective wide region being somewhat wider than the diameter of the cylindrical head of screws 34, while the narrow regions are somewhat wider than the screw diameter of cylindrical-head screws 34.

When containers 21 and 22 are attached to housing 4 cylindrical-head screws 34 are aligned with openings 38 of central wall 25. This permits the insertion of a screwdriver or the like through openings 35 on one hand and openings 38 on the other hand upon swinging out of covers 39 and 39' pivotable about axles 40 and 40' in order to firmly attach containers 20 and 21 to the respective sides of stand 2.

If the containers have to be replaced, it is merely necessary to loosen cylindrical-head screws 34. Following that step containers 20 and 21 are respectively slid upwards from the position shown in FIG. 2 and then detached; newly replaced containers are attached following the aforesaid procedure in reverse order.

Figure 4:
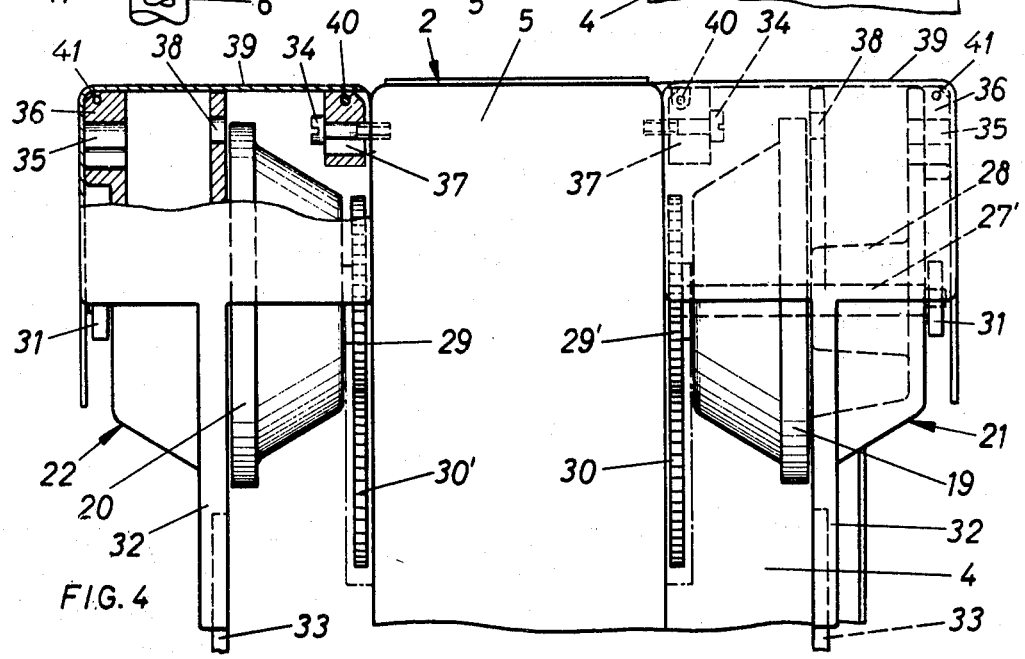
FIG. 4 corresponds to the view of FIG. 2, but with reversed containers.

If the orientation of the rivets, press fasteners and the like requires to be changed, the containers can be reversed with respect to machine stand 2, as can be seen by viewing FIGS. 2 and 4. To this end covers 39 and 39' must also be reversed and hinged on opposite sides of respective housings 22 and 21. For that reason suitable holes 41 and 41' are provided for interchangeably positioning pins 40 and 40' on respective opposite sides of machine housing 4. Also shafts 27 and 27' are interchanged with respective gear wheels 29 and 29' so that gearwheel 29 is now attached to shaft 27' and gearwheel 29' is now attached to gearwheel 27; cylindrical-head screws 34 are then passed through openings 35, and then tightened to machine housing 2 in the usual manner.

Since supply rails 33 and 33' are detachable from respective arms 32 and 32', the former are also interchangeable.

The rivets, press fasteners and the like which glide along supply rail 33 or 33' and which are associated with upper tool 6 arrive within the region of push rod 42, which slides these parts into tongs 43. Push rod 42, whose rhythm is controlled by the machine also controls the placements of corresponding parts leaving the supply rail associated with lower tool 11', and pushes them into tongs 43 associated with the formers.

Tongs 44 encompassing upper tool 6 are controlled via a Bowden cable 45 and a foot pedal 46. On depressing foot pedal 46 tongs 43 are depressed via a pushing rod 47 in a downward direction; the former serves to position the rivets, press fasteners and the like securely and also protects the fingers of the operator.

We claim:

1. In a machine for the attachment of fasteners comprising a machine head, an upper tool and a lower tool mounted on said head for applying upper and lower fastener parts to an article, said head having a pair of lateral flanks, and drive means in said rotatable head, for feeding fastener parts to said tools, the improvement which comprises:

a pair of housings each including therein a tumbler drum rotatable to dispense respective fastener parts, each of said housings having a pair of opposite sides;

hanger means on each of said flanks of said head for engagement with either of said sides of a respective one of said housings for supporting said housings interchangeably on said flanks of said head;

a drive element extending from each of said sides of each housing for coupling to said drive means upon hanging of each housing on a respective flank of said head; and a respective supply rail extending from each of said housings to a respective one of said tools for delivering the respective fastener parts thereto, said supply rail each being detachably secured to the respective housing and removable therewith from said head.

2. The improvement defined in claim 1 wherein said means for hanging said housings on said flanks include elements threaded into said head and keyhole-shaped slots formed in said sides of said housing for receiving said elements, said elements being accessible through the side of each housing opposite that engaging said elements for tightening said housing against said head.

3. The improvement defined in claim 1, further comprising a stand carrying said head and formed with a plurality of openings at vertically spaced locations therealong;

an arm receivable selectively in said opening, and carrying said lower tools;

means for securing said head on said stand at selected locations therein; and means for securing said arm in said stand at a selected opening.

* * * * *